US007100785B1

(12) United States Patent
Suffa

(10) Patent No.: US 7,100,785 B1
(45) Date of Patent: Sep. 5, 2006

(54) CLOSURE CAP COOPERATING WITH A BOTTLE TYPE CONTAINER

(75) Inventor: Udo Suffa, Gefell (DE)

(73) Assignee: Alpla-Werke Alwin Lehner GmbH & Co.KG, Hard (AT)

( * ) Notice: Subject to any disclaimer, the term of this patent is extended or adjusted under 35 U.S.C. 154(b) by 7 days.

(21) Appl. No.: 10/110,810

(22) PCT Filed: Oct. 18, 2000

(86) PCT No.: PCT/EP00/10251

§ 371 (c)(1),
(2), (4) Date: Oct. 9, 2002

(87) PCT Pub. No.: WO01/28868

PCT Pub. Date: Apr. 26, 2001

(30) Foreign Application Priority Data

Oct. 18, 1999 (DE) ..... 199 50 107

(51) Int. Cl.

| | |
|---|---|
| ***B65D 5/74*** | (2006.01) |
| ***B65D 41/08*** | (2006.01) |
| ***B65D 55/02*** | (2006.01) |
| *B65D 25/42* | (2006.01) |
| *B65D 35/38* | (2006.01) |

(52) U.S. Cl. ..... 215/330; 215/211; 215/217; 215/334; 222/568; 222/569; 222/570

(58) Field of Classification Search ..... 215/330, 215/318, 211, 216, 258, 217, 218, 223, 331, 215/334; 220/259.3, 259.4; 222/567–570
See application file for complete search history.

(56) References Cited

U.S. PATENT DOCUMENTS 4,588,097 A * 5/1986 Hauser ..... 215/216
4,940,167 A * 7/1990 Fillmore et al. ..... 222/153.09
4,948,002 A * 8/1990 Thornock et al. ..... 215/221
5,213,225 A * 5/1993 King et al. ..... 215/330
5,560,505 A * 10/1996 Schneider et al. ..... 215/330
5,687,863 A * 11/1997 Kusz ..... 215/216
5,806,698 A * 9/1998 Aguirrezabal ..... 215/235
6,039,197 A * 3/2000 Braun ..... 215/228
6,182,822 B1 * 2/2001 Albisetti ..... 206/221

(Continued)

FOREIGN PATENT DOCUMENTS

DE 1916954 11/1969

(Continued)

*Primary Examiner*—Stephen K. Cronin
*Assistant Examiner*—Niki M. Eloshway
(74) *Attorney, Agent, or Firm*—Martin A. Farber

(57) ABSTRACT

A closure cap (1) which interacts with a bottle vessel (4), a latching projection (5) being formed on a bottle neck (3) of the bottle vessel (4), and an engage-under projection (6') being formed on the closure cap (1), an insert part (2) furthermore being coordinated to the closure cap (1), said insert part (2) is fastenable to the bottle neck (3), and the closure cap (1), which is knockable on to the insert part (2), is unscrewable from the insert part (2), and wherein the insert part (2) has means for holding on the bottle neck (3) in a manner secured against rotation, the latching projection (5) is formed as a screw thread on the insert part (2), and for childproof holding of the closure (1) on the insert part (2), the insert part (2) or the bottle neck (3), in a region of a pedestal step (31), has a latching shaped-out portion (30) which interacts with a mating projection or a recess on the closure cap (1).

34 Claims, 13 Drawing Sheets

U.S. PATENT DOCUMENTS 6,609,637 B1 * 8/2003 Suffa ..... 222/545

FOREIGN PATENT DOCUMENTS

| | | |
|---|---|---|
| DE | 19824714 | 4/1999 |
| EP | 0635435 | 1/1995 |
| EP | 0676338 | 10/1995 |
| GB | 2172273 | 9/1986 |
| WO | 9921772 | 5/1999 |

* cited by examiner

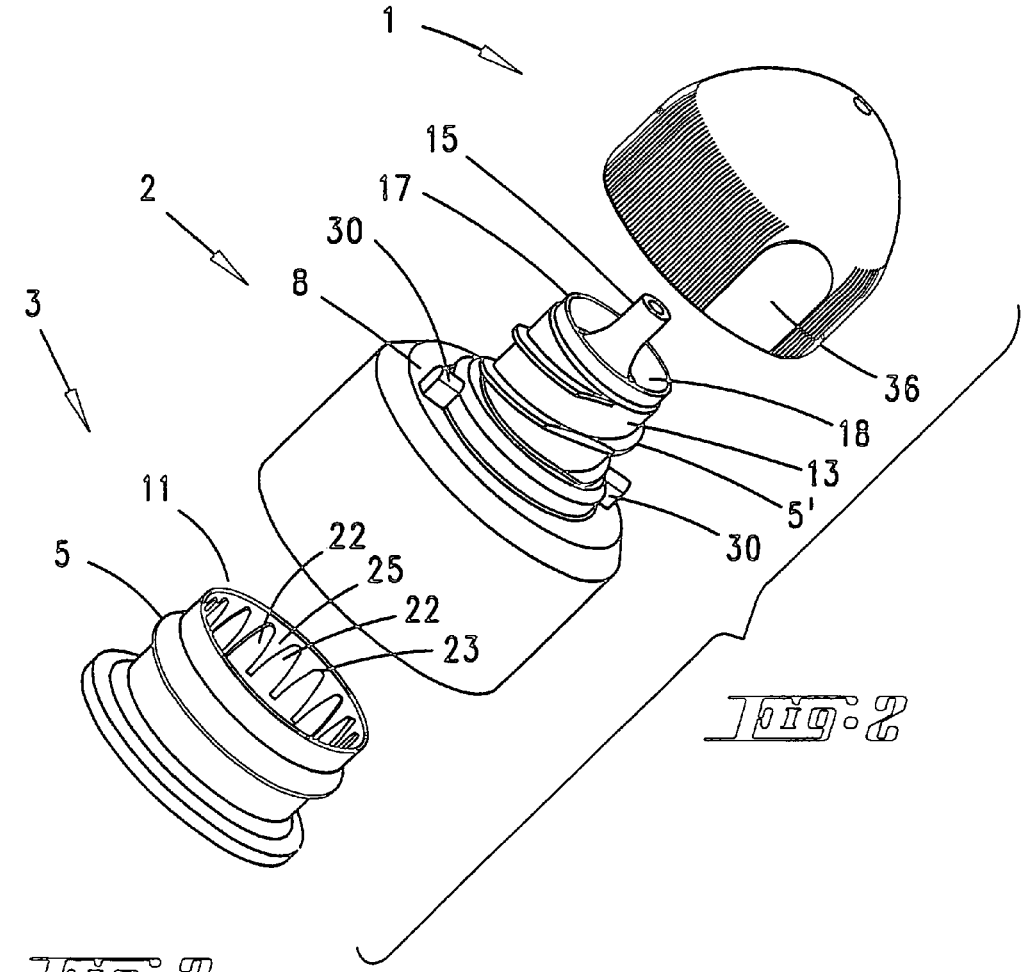
Fig: 2
Fig: 3
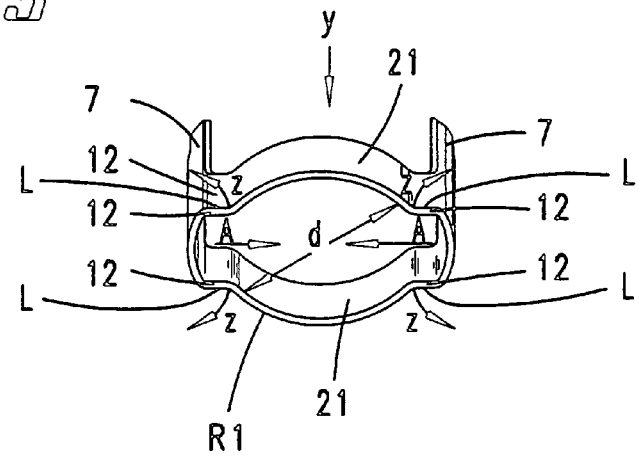

CLOSURE CAP COOPERATING WITH A BOTTLE TYPE CONTAINER

FIELD AND BACKGROUND OF THE INVENTION

The invention relates to a closure cap which interacts with a bottle vessel, a latching projection being formed on the bottle neck of the bottle vessel, and an engage-under projection being formed on the closure cap, and an insert part furthermore being associated with the closure cap, which insert part can be fastened to the bottle neck.

A closure cap of this type which can be connected to the bottle neck of a bottle vessel is known from DE-A 198 24 714. In that document, the engage-under projection is in the form of a ring. It has a length reserve which is sufficient to move over the latching projection, with the action of a highly effective elastic restoring means. The engage-under projection, i.e. the ring, can in practice be knocked on, acting as a neck noose. The closure cap can be unscrewed and screwed on again as a result of the rising profile of latching projection and engage-under projection in combination with run-out ends of the latching projection. A secret actuating feature is used to secure the receptacle. Furthermore, in one exemplary embodiment of the precursor arrangement, there is an associated insert part. By this means, it is possible to minimize the size of the inherently relatively large delivery opening, so that instead of a flowing jet it is also possible to deliver a powerful spray jet, even with a spray nozzle being formed on the insert part.

SUMMARY OF THE INVENTION

It is an object of the invention to form a bottle vessel with closure cap of the generic type which is structurally advantageous and operationally reliable in terms of the insert part.

This object is achieved firstly and substantially in a closure cap with bottle vessel wherein it is provided that the insert part has means for holding on the bottle neck in a manner secured against rotation, and that the closure cap, which can be knocked onto the insert part, can be unscrewed from the insert part. This results in an advantageous adapter, in which the advantageous ring/retaining principle which has been explained can be applied not only between the bottle vessel and the insert part, but also between the insert part, which now offers a neck of reduced cross section, and the closure cap which fits over the insert part. Although the opening and closing actuating forces of the closure cap flow via the insert part, it is not made to co-rotate through frictional engagement; the means for rotationally secure holding, which can be achieved even by means of roughening, holds the insert part in place in an operationally reliable manner. Therefore, in this case knocking on the functional parts provides the advantage of rapid assembly. Closure cap and insert part can be connected during pre-assembly to form an ultimately associable unit, so that, as the final step, it is merely necessary to close the bottle neck. Accordingly, it is also of general advantage that an engage-under projection is formed on the insert part in order to interact with the latching projection on the bottle vessel. For example, it is in this case also provided that the engage-under projection of the insert part is formed on a circumferentially encircling ring which, in the circumferential direction, has a length reserve which is sufficient to move over the latching projection and can be utilized with elastic restoring. All this can be achieved with a maximum thin-walled nature of the ring. The latter feature means that material is saved. The greater structural extent lies in the insertion direction. A long rectangular cross section of a ring of this type is sufficient to securely overcome the latching projection formed on a bottle neck which includes a delivery opening. If no opening-control means are provided, accordingly, there is then irreversible latching to the bottle neck or the bottle vessel. Furthermore, it is provided that the latching projection is formed on a bottle neck which has a neck opening, and that the latching arm runs substantially parallel to a longitudinal center axis of the delivery opening. This allows sufficient knocking forces to be transferred without damage. A latching arm with particular long-term stability is produced if it participates in the ring shape. An advantageous solution is achieved if two latching arms, which lie substantially opposite one another, are formed. The length reserve is easily achieved on account of an undulating construction of the ring. In this case, it is sufficient if only part of the ring undulates in the peripheral direction. However, the zone of the length reserve which deviates from a standard circular ring contour may also be produced in such a way that the length reserve is formed by an ability to yield in the region of the attachment to the latching arm of the ring. This applies in a corresponding way to both latching arms, specifically on both sides. Furthermore, there is provision for the ring to run substantially perpendicular to the latching arms. In this case, the invention proposes that the latching projection be formed on the bottle neck in a plane which runs perpendicular to the center axis of the bottle opening. Furthermore, it is provided that the insert part has a central collar for engaging in the neck opening of the bottle vessel, the collar having an introduction slope for interacting with an inner-rim edge of the neck opening. The, for example, rotationally symmetrical introduction slope provides an effective pre-centering with respect to the inner-rim edge, i.e. the mouth of the bottle. Therefore, when the parts are being docked, it is no longer so easy for a collision to take place in the event of the component which is to be introduced not approaching linearly. In this respect, even a relatively small outer-rim-side narrowing of the free end of the collar is sufficient. For example, it is in practice sufficient even if the introduction slope extends inward at least by an amount of one wall thickness of the collar. In any event, one is on the safe side if the introduction slope has a dimension which is a multiple of the wall thickness of the collar. This may be up to five times. It is expedient if the introduction slope is formed from a plurality of separate introduction tongues. The tongues have convex end rounding and may also be formed into a lip toward the free end in terms of their walls. As has been found, a plurality of introduction tongues distributed at equal angles are sufficient. On the container side, the bottle neck, i.e. its inner-rim edge, may additionally be beveled. With further regard to the means for holding the insert part in a manner which is secured against rotation, this means is formed on the bottle neck side in the form of shaped-out portions. It is expedient for shaped-out portions of this type to comprise vertically oriented ribs. These ribs are of tongue-like form, with a tongue tip associated with the neck opening. This tongue tip forms, in the manner of a "flow divider", a diverting feature for the mating means, on the insert part side, for holding in a manner which is secured against rotation. The said ribs may simply be formed by recesses in the inner wall of the bottle vessel. In this case, the invention proposes that the means for holding the insert part in a manner which is secured against rotation are formed by blocking strips, which pass into the recesses between the ribs, of the insert part. They can be molded directly. It is not necessary for the blocking strips to be provided in the same number as the number of shaped-out portions. Furthermore, the solution according to the invention is characterized in that the insert part, associated with an engage-under projection of the closure cap, forms a latching projection. In order, in this case, despite the good retaining of the closure cap, to ensure that it can be released by simple means, it is furthermore provided that the latching projection of the insert part and the engage-under projection of the closure cap, in a lateral projection, include an acute angle with a horizontal. For example, the latching projection, with a corresponding profile of the closure-cap-side engage-under projection, can change to the function of a screw thread, with one or more leads. In this case, it is provided that the ring which runs at an acute angle comprises two sections which lie substantially opposite one another and cover the same height region. In this solution, the basis of the opening control referred to above is if the closure cap is to be reversibly associated with the bottle vessel. Accordingly, in this case the latching projection is formed as a mating screw thread on the insert part. A configuration which is of safety-related importance and more resides in the closure cap being childproofed on the insert part. The insert part may in this case also be fastened, i.e. formed, directly on the bottle neck. This is specifically implemented in the following combination of features, which consists in the fact that the insert part or the bottle neck, in a region of a pedestal step, has a latching shaped-out portion which interacts with a mating projection or a recess on the closure cap. In detail, in this case a configuration is selected in such a manner that the mating projection is formed as strips which are configured mirror-symmetrically, are directed toward one another in cross section and extend in the radial direction, and which, at their free ends, between them leave an opening which corresponds to the latching shaped-out portion. The latching shaped-out portion snaps into this opening. As a result, at the same time a security feature preventing the closure cap from being released of its own accord is provided. Balanced and therefore tilting-free handling ability of this childproofing means is provided by two mating projections which lie on a diametral. In detail the preferred solution is such that the strips can be lifted away from the latching shaped-out portion by depressing sections of the peripheral wall of the closure cap in positions which are offset at 90° with respect thereto. The peripheral wall is deformed, for example, from a circular shape into an oval shape, with correspondingly radial deflection of the mating projections. Then, the invention consists in the formation of a childproof closure cap for a bottle vessel, which solution is characterized by strips which form mating projections, are aligned mirror-symmetrically and, in cross section, are directed toward one another, in such a manner that their free ends, between them, leave an opening for accommodating a latching shaped-out portion of the bottle vessel or of the insert part. In this case, the structural procedure is such that the latching shaped-out portion can move over one strip, subsequently restoring itself, and the other strip forms a rotation-blocking stop for the closure cap.

Furthermore, it is provided that the insert part or the bottle neck, in a region above the latching projection, has a latching shaped-out portion which interacts with a recess on the closure cap. This results in even more effective, in practice "harder" childproofing, with a correspondingly increased safety of use of the dispenser or receptacle. In this context, it is structurally advantageous if the recess is formed in a security wall which is separate from the cap wall of the closure cap and is disposed radially inwardly with respect thereto. For example, childproofing and rotation-blocking means may be formed at different locations, in each case increasing effectiveness. While retaining the basic contour of the rings, the security wall also has an oval basic contour. A profile running in the same direction is present. In a structurally simple manner, the recess is formed as a vertical slot, the wall end regions which form the slot being reinforced by integrally molded ribs running at right angles thereto. For example, with regard to the security wall it is possible to operate with extremely thin walls. Nevertheless, the desired mechanical strength of the recess is still present. The above-mentioned separate form of the security wall does not mean a multipart form; accordingly, the further procedure is such that the ring which interacts with the latching projection is attached to the security wall. The attached ring is configured in the manner of a strap, with an oval basic contour which is matched to the security wall. Moreover, the invention proposes that the security wall is disposed so as to be radially inwardly offset with respect to the attached ring. The offset may be produced so as to amount to the dimension of one wall thickness. The poly-directionality obtained as a result has a consolidating action, which proves useful in particular for actuation. This is because the security wall is connected to the cap wall which is moved by the release pressure, where the sections for depressing the cap wall of the closure cap are also located. The security wall, or its recess, which lies more on the side of the closure-cap head, interacts with a latching shaped-out portion which lies on the cap cover side, which latching shaped-out portion is arranged to protrude over a rim of a connection piece. This latching shaped-out portion is also provided in pairs. A configuration which is even of independent importance is realized by the fact that a mating projection, which interacts with a stop edge of the latching shaped-out portion, is formed on the insert part or the bottle neck. In terms of its basic contour, this latching shaped-out portion is formed on the shape of a hook, forming a trapping corner for the closing mating projection. Childproofing means and rotation-blocking means are therefore devices which are disposed separately from one another. Finally, it is also proposed that the cap wall is preceded on the radially inner side, in the release-pressure direction of its actuating section, by an annular step which can be overcome, and the corresponding closure-cap rim has a bead which interacts with the annular step. This device can be set for a certain threshold. Therefore, release is not possible by ordinary tentative touching.

BRIEF DESCRIPTION OF THE DRAWINGS

The subject matter of the invention is explained in more detail below with reference to an exemplary embodiment and developments illustrated in the drawing, in which:

FIG. 2 shows a perspective, exploded view of closure cap, insert part and bottle neck (the bottle body is not illustrated).

FIG. 3 shows the engage-under projection, which is configured as a ring, of the insert part, in a perspective illustration viewed from below, FIG. 17 shows in worm's eye view, an internal illustration of the closure cap of the closure in vertical section, modified in such a manner that childproofing means and rotation-blocking stop are formed separately.

DETAILED DESCRIPTION OF THE PREFERRED EMBODIMENT

Figure 1:
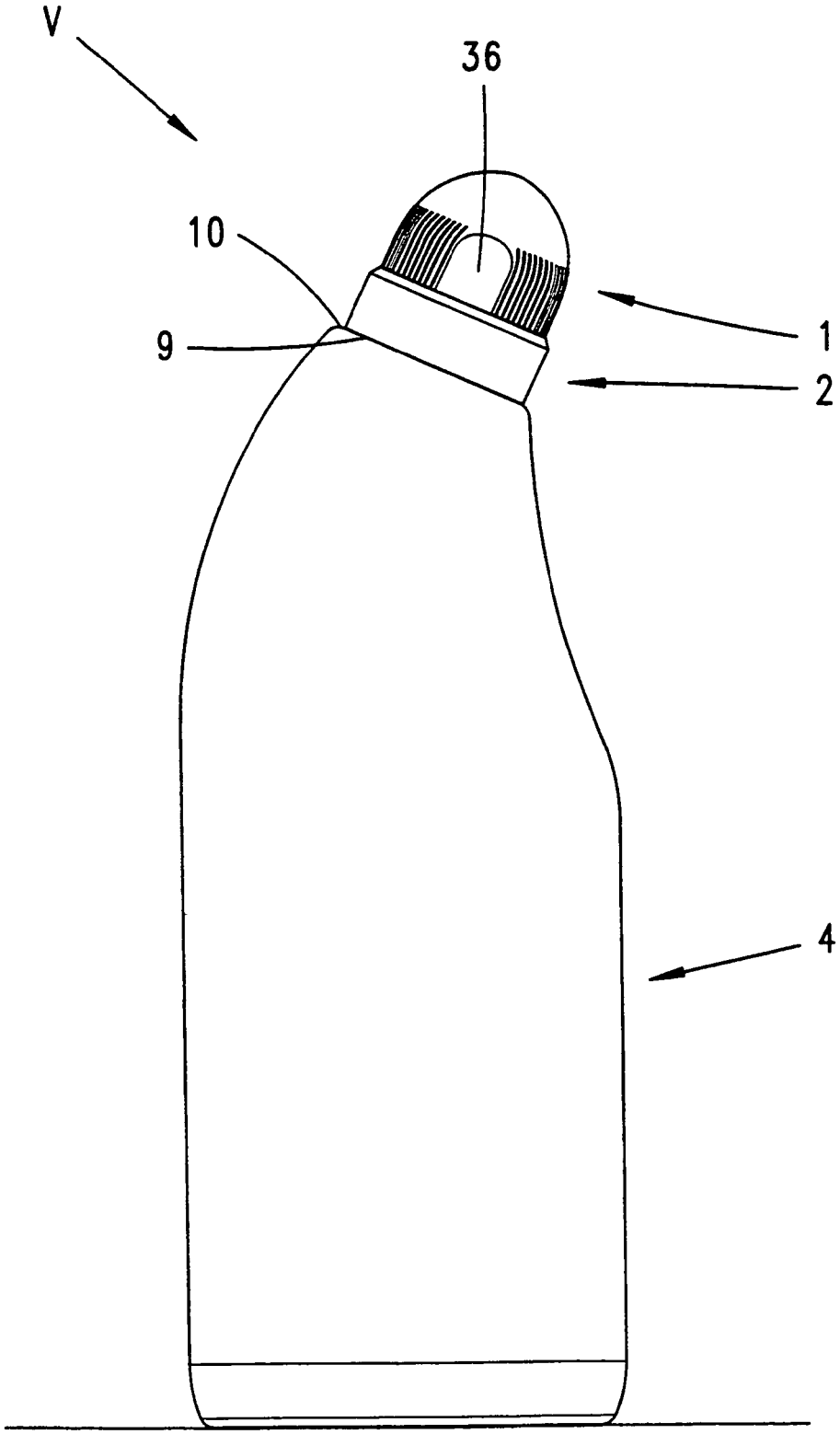
FIG. 1 shows a closure according to the invention with bottle vessel in the form of an inclined-neck bottle, in front view.

The illustrated closure V of a dispenser or receptacle comprises a closure cap 1, an insert part 2 and a bottle neck 3 of a bottle vessel 4. The bottle vessel 4 may be a preform bottle vessel.

The closure cap 1 can be associated with the insert part 2 by being knocked onto it. It can also be associated with it by screwing and accordingly can be unscrewed again.

By contrast, the insert part 2 is irreversibly latched closed to the bottle neck 3. For this purpose, the bottle vessel 4 or its bottle neck 3 has a latching projection 5 on the peripheral wall side with respect thereto. The latching projection is in the form of a continuously encircling (or interrupted, if releasability is also desired here) annular bead. The upper flank of the latching projection 5 drops away obliquely toward the outside and in the direction of the bottle vessel 4. By contrast, the lower flank of the latching projection is set to be steep, i.e. it extends substantially horizontally, i.e. perpendicular to a vertically oriented longitudinal center axis x-x of the bottle neck 3.

The latching means on the insert part side is an engage-under projection 6. This is formed as a ring R1. In the case of the knocked-together association which is applied in this case too, the engage-under projection 6 slides over the above-described inclined flank of the latching projection 5 and ultimately passes, with an anchoring action, under the steep flank, to which it is securely latched.

The ring R1 is supported by two latching arms 7 which are oriented in a vertically suspended manner. They start from a substantially horizontally extending cover 8 of the insert part 2, which is of substantially cup-shaped configuration in its base region. The end edge 9 of the cup-shaped insert rests flush on a peripheral shoulder 10 of the bottle vessel 4 in such a manner as to limit the depth of insertion.

The ring R1, which in FIG. 3 is illustrated more in the form of an outline sketch, is realized as a continuous, axial strap contour which is practically in the form of a section of tube. The strap is substantially rectangular in cross section and, in the region of its narrow side, which forms the engage-under projection 6, is sharpened in the manner of a cutting edge, with an outer inclination which runs in the direction away from the cover. This latter feature promotes anchoring. The longer side of the strap lies in the insertion or knocking direction of association (arrow y) of the insert part 2.

In its basic position, the ring R1 has an internal diameter d which substantially corresponds to the external diameter D of the bottle neck 3 in the latching region of the ring R1. Moreover, the ring R1 has sections which are larger than its internal diameter d. These sections create a length reserve L. The latter is dimensioned such that the ring R1 can be widened counter to a restoring force which is inherent to the ring. This state occurs if the ring R1 has to overcome the latching projection 5, which has a larger external diameter D than d, which, as has been stated, occurs during the knocking association.

The length reserve L is achieved in the ring R1 for example on account of an undulating construction of the ring R1. This version is not illustrated, since it is particularly easy to imagine. The strap stretches in such a manner as to smooth out the undulations and thereby contributes to the desired length reserve L.

In the version of the ring R1 which is illustrated in FIG. 3, the length reserve L is located in the ring-side attachment region of the latching arms 7, which latching arms 7 themselves are also curved in the form of part of a circular ring, but lying on a different, larger-diameter arc plane. In terms of cross section, they run substantially rotationally parallel with respect to the longitudinal center axis x-x of the bottle neck 3 or of its neck opening 11. As can likewise be seen from FIG. 3, the strap, in the region of the securing of the latching arms 7, continues into the latching arms via limbs 12. There, the strap forms, as it were, a bulge which is similar to a bay window. As shown in FIG. 3, the limbs 12 are oriented so as to run substantially parallel. As illustrated, the transitions may be slightly rounded. The length reserve L, which in this case, as with the undulation explained, is produced on the basis of a change in direction of parts of the strap, includes an identical ability to yield. The yielding directions of the two limbs 12, which face away from one another, are indicated by arrows z. The limbs 12 act as articulation tabs. This leads to the superimposition of a radially inward approach of the lower ends, which partly form the strap, of the latching arms 7. This direction of movement is illustrated by arrow A.

Figure 4:
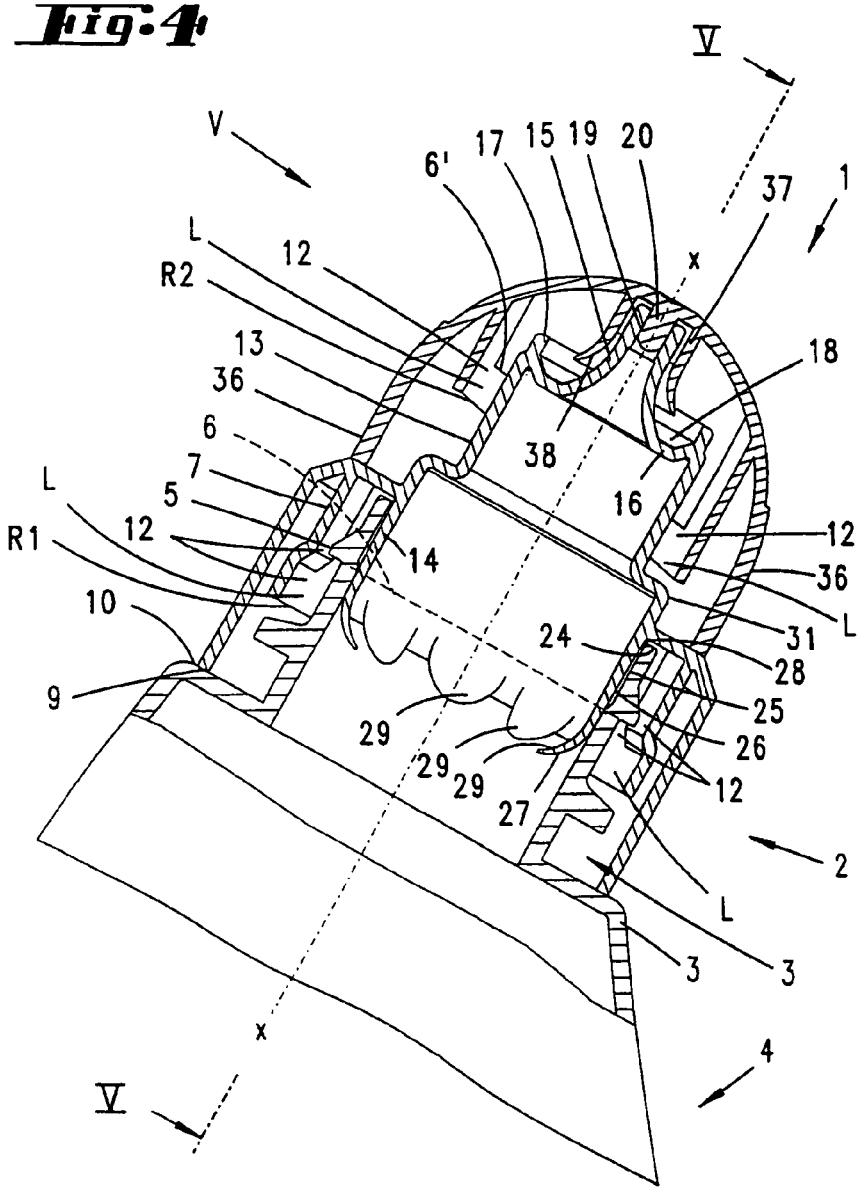
FIG. 4 shows a vertical section through the closure shown in FIG. 1.
Figure 9:
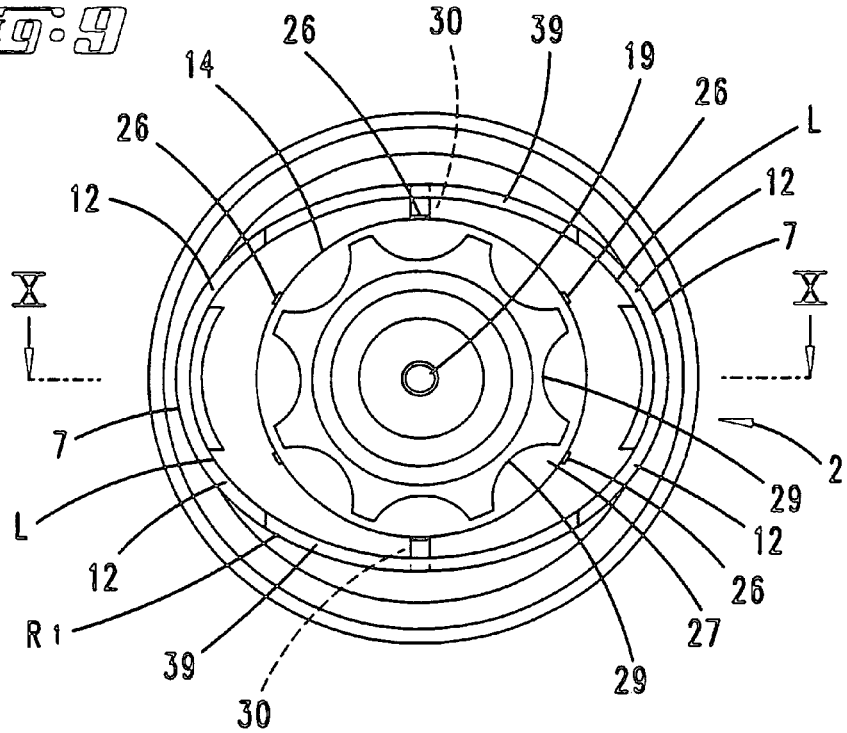
FIG. 9 shows the insert part in a view from below.
Figure 10:
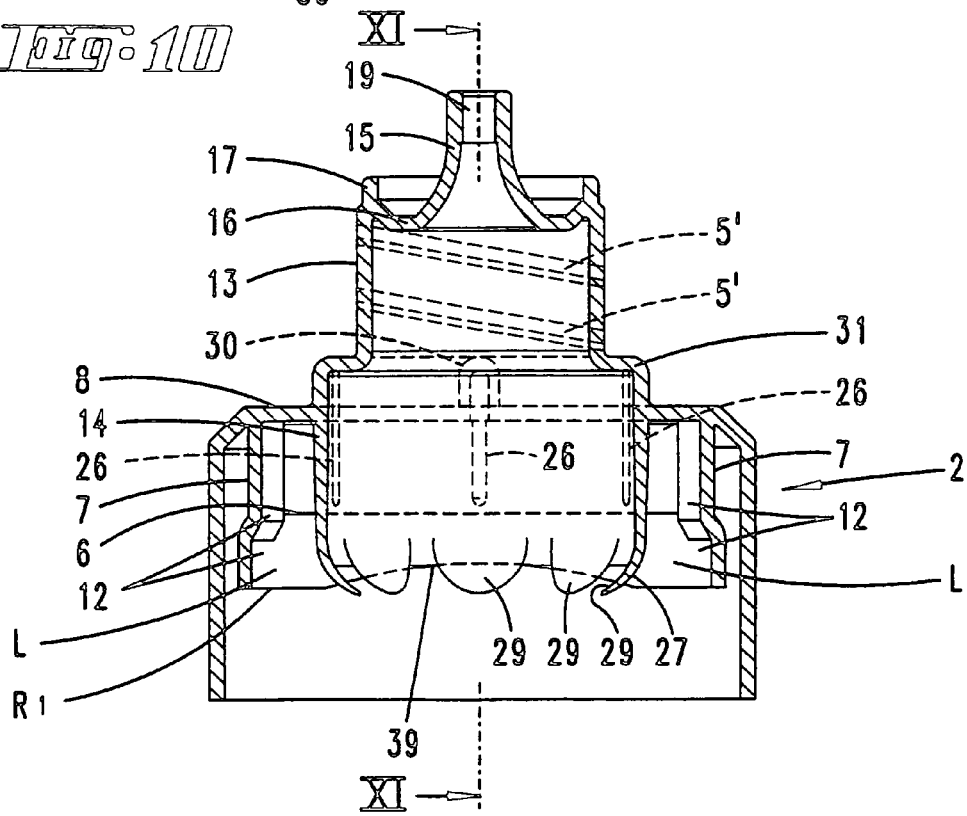
FIG. 10 shows the section on line X—X in FIG. 9.
Figure 11:
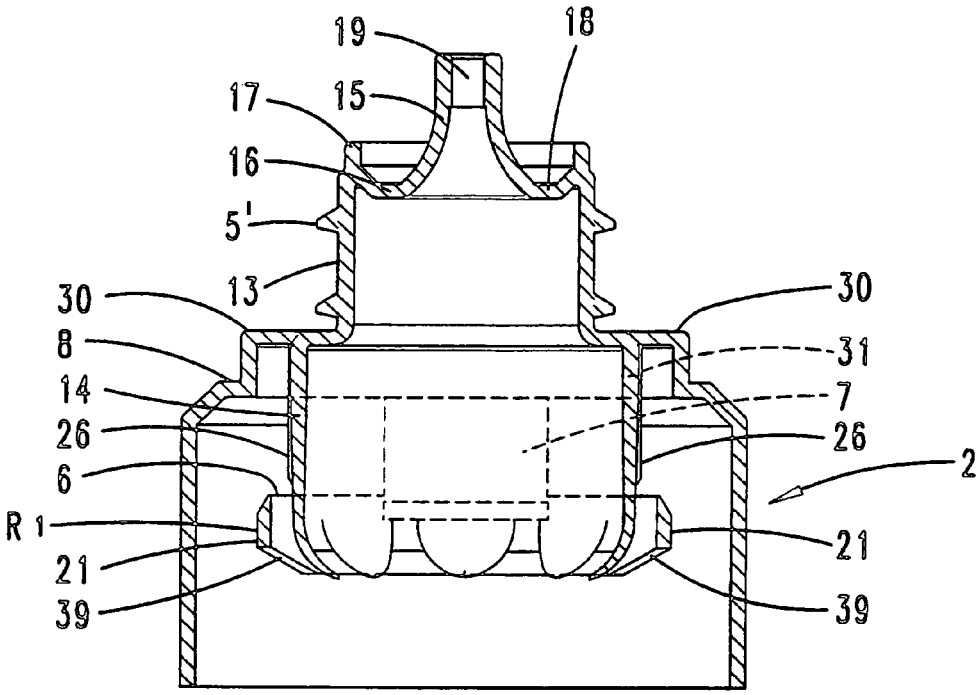
FIG. 11 shows the section on line XI—XI in FIG. 10.
Figure 12:
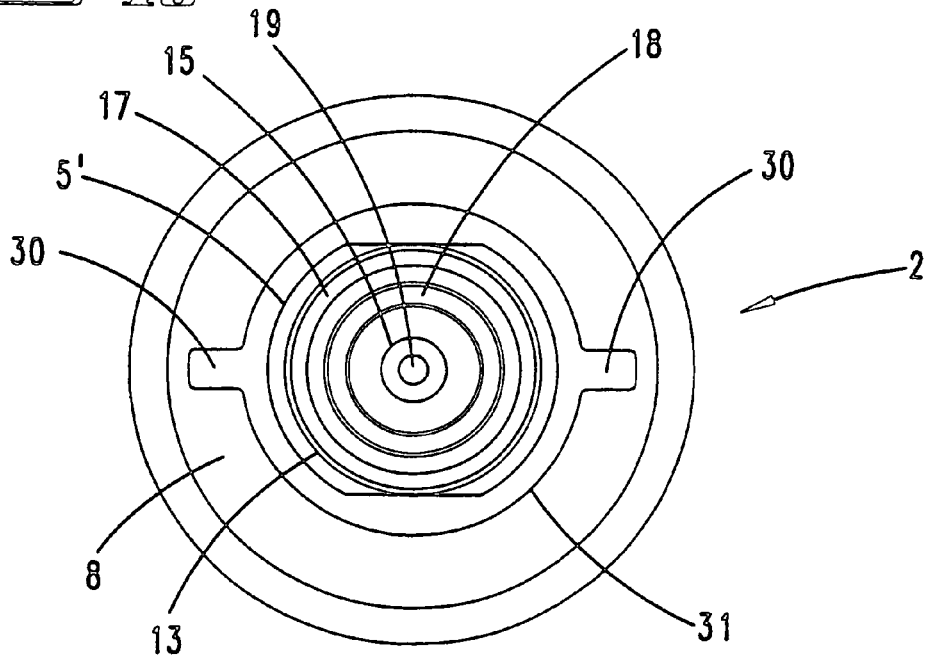
FIG. 12 shows a plan view of FIG. 11.

With the stamped-out form of the ring R1, which is illustrated from FIG. 4 onward and the basic contour of which is clearly apparent from FIG. 9, there is an elliptical profile. In this case, the longer ellipse bends, which have their roots in the latching arms 7, form the abovementioned length reserve L. In this case, the latching arms 7 are drawn in by approximately the wall thickness of the strap and likewise have their roots in the cover 8 of the insert part 2. Moving into the rounded section, which it is possible to slip over, the latching arms 7 are pulled slightly toward one another, forming a further spring reserve.

Starting from the cover 8 which forms the basis of the cup shape—forming the base of the cup—the insert part 2 continues into a connection piece 13, which extends in a direction away from the interior of the cup, i.e. upward in the illustration presented in the drawing. Said connection piece 13 lies centrally and, in terms of its diameter, approximately corresponds to the radius of the cup-shaped insert part 2.

As can be seen, at its foot side, the connection piece 13 is rooted in a region which still exceeds the width of the connection piece, referred to below as the pedestal step 31.

This region is of plateau-like configuration and continues in the opposite direction, i.e. running into the cup interior, into a collar 14.

On the upper side, the connection piece 13 forms a centrally located spray nozzle 15, which rises, in the manner of a chimney, from the base of an inner cover 16, which runs parallel to the cover 8, of the insert part 2.

The inner cover 16 is set back with respect to the slightly exposed connection-piece rim 17 so as to create an annular channel 18. This channel collects any delivered substance which drops back. In terms of its cross section, the nozzle opening 19 of the insert part 2 is considerably reduced compared to the neck opening 11 of the bottle vessel 4. Accordingly, a powerful, directionally stable spray jet can be delivered via the nozzle opening 19, for example as a result of an external pressure being exerted on the body of the bottle vessel 4, the wall of which is at least partially configured for corresponding collaboration. By contrast, the larger neck opening 11 promotes the filling of the bottle vessel 4.

At times when it is not being used, the bottle vessel 4, which is equipped with the insert part, can be closed tightly; the closure cap 1 mentioned in the introduction is used for this purpose. In terms of forming a seal, this is effected by means of a stopper 20, which originates from the inner side of the closure cap 1, which is in this case of dome-like configuration, and engages in the nozzle opening 19 of the spray nozzle 15.

Figure 15:
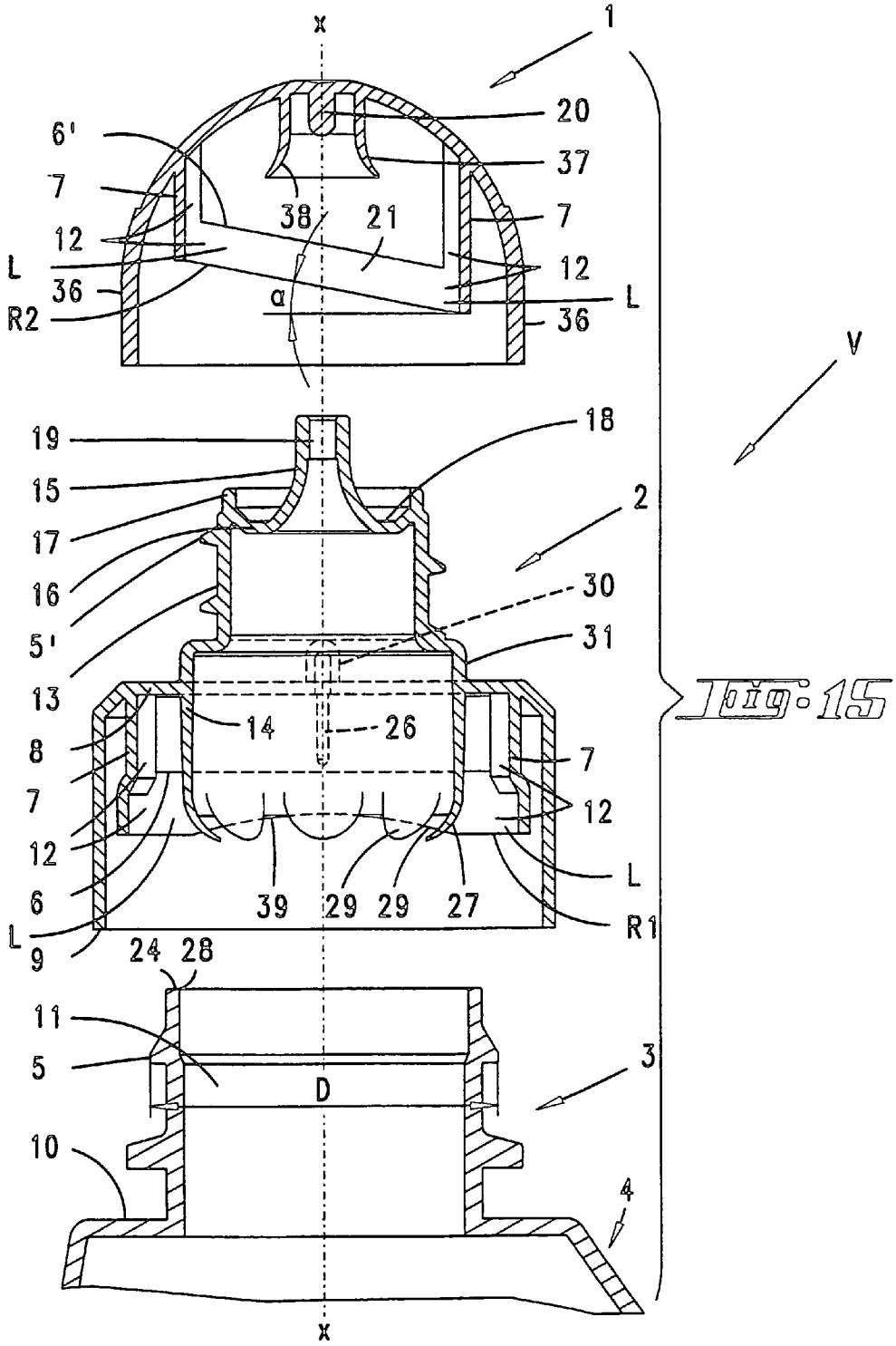
FIG. 15 shows an exploded illustration corresponding to that shown in FIG. 2, in section, but on an enlarged scale compared to FIG. 2.

As has already been emphasized in the introduction, the closure cap 1 can be knocked onto the insert part 2 and can be unscrewed again from the insert part 2. This applies the same basic principle as the neck noose, provided by a ring R2 of the closure cap 1. While in connection with the ring of the insert part 2 which is denoted by R1 the latching projection 6 on the bottle neck 3 in that instance is formed with a plane extending in a plane which is perpendicular to the longitudinal center axis x-x of the neck opening 11 of the bottle neck 3, the latching projection 5' of the insert part 2 and the engage-under projection 6' of the closure cap 1, in a lateral projection, include an acute angle alpha with a horizontal. Reference is made to FIG. 15. In this case, the section 21 of the ring R2 or strap which lies substantially between the latching arms 7 constitutes a thread-forming region; the associated latching projection 5' is also realized as a screw thread. There may be a single-lead or multiple-lead screw thread. The pitch is approximately 20°. The latching-projection screw thread sections, on diametrically opposite regions, run back to the diameter dimension of the peripheral wall of the connection piece 13. As a result, the ring R2 is released as a result of correspondingly running beneath and leaving the horizontal flank of the latching projection 5'. The regions are path sections which are in the form of segments of a circle.

It can be seen from the drawing that the ring R2, which runs at the acute angle alpha, comprises two sections 21 which lie substantially opposite one another and cover an identical height region. The height region is defined by the upper and lower ends of the latching projection 5', which is in this case inclined, forming the screw thread of the insert part 2.

The insert part 2 is associated with the bottle neck 3 not only so that it is blocked against being pulled out in the axial direction, but also in such a manner that it is secured against rotation. Therefore, the screwing and unscrewing movement of the closure cap 1 cannot pass into a void, i.e. be converted into a rotation of the insert part 2.

Figure 13:
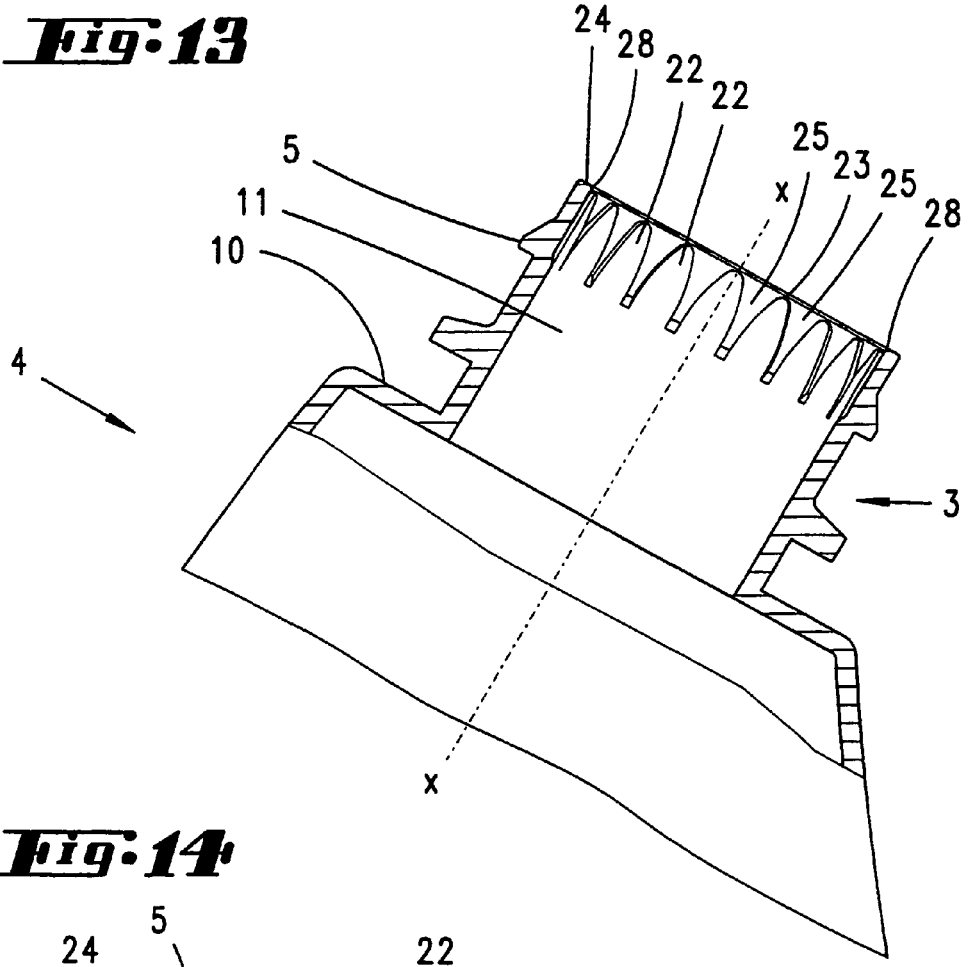
FIG. 13 shows a vertical section through the region of the bottle neck.
Figure 14:
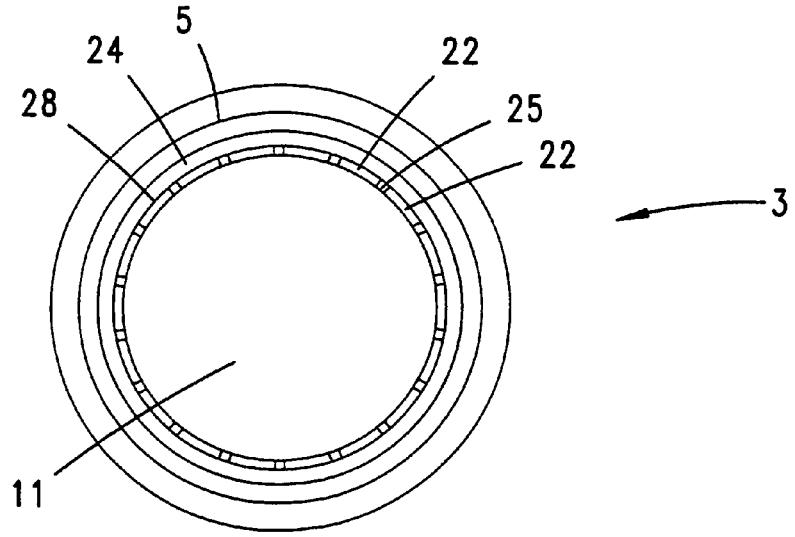
FIG. 14 shows a plan view of FIG. 13.

On the bottle neck side, the means for holding the insert part 2 in a manner which is secured against rotation consists in the form of shaped-out portions. Reference is made to FIGS. 1 and 13. The shaped-out portions are in this case formed or delimited by vertically oriented ribs 22, which are located at the entry to the neck opening 11, where they appear as a serrated ring forming a crown structure.

The ribs 22 are of tongue-like configuration. The tongue tip tapers outward. It is denoted by 23 and ends shortly before the end edge 24 of the bottle neck 3.

The ribs 22 are flush, in the same plane, with the cylindrical inner wall of the neck opening 11.

The ribs 22 are formed by recesses 25 which start from the inner wall. They diverge in the outward direction, so that there is a multiplicity of identically shaped collection funnels with respect to the rotation-securing mating means of the insert part 2.

The means for holding the insert part 2 in a manner which is secured against rotation furthermore comprises blocking strips 26 which pass into the recesses 25 between the ribs 22. These strips are located on the peripheral wall of the cover-side, substantially cylindrically configured collar 14 of the insert part 2. The blocking strips 26 can be seen particularly clearly from the view from below illustrated in FIG. 9, as can their uniform angular distribution. A total of six blocking strips 26, which run in the insertion direction, are integrally formed. Opposite them, in the neck opening 11, are eighteen recesses 25. These too are distributed at equal angles over the circumference. The result is a correct, unforced angular orientation between the two parts 2, 3.

That end of the recesses 25 which is remote from the end edge has a clear width which corresponds to that of the blocking strips 26; the plug connection is therefore ultimately produced without any clearance for rotation.

The collar 14, which is responsible for the sealing function with respect to the bottle neck 3, functions as a closure member resembling a hollow stopper, so that the region of the join between the bottle neck 3 and the insert part 2, which is associated for insertion, is leak-free.

Furthermore, the collar 14 performs an additional function, specifically with a view to secure plug-together assembly of the parts 2, 3. Specifically, the procedure is such that the insert part 2, by means of the centrally located collar 14 engages into the cylindrical neck opening 11 of the bottle neck 3 in a pre-centering manner. For corresponding pre-centering, the collar 14 has an introduction slope 27. This is located at least on the outer side of the collar 14 and goes significantly beyond the action of an outer edge bevel of a standard sealing collar, since the introduction slope 27 extends inward at least by an amount corresponding to the wall thickness of the collar 14. The inclination is close to 45° with respect to the longitudinal center axis x-x of the closure V.

The introduction slope 27 interacts with a diverting inner-rim edge 28 of the neck opening 11. The inner-rim edge 28 may, contrary to what is illustrated, be beveled. At that location, as can be seen from FIG. 15, the neck opening 11 may be slightly widened. As can be seen from FIG. 13, this widened zone has the rotation-securing shaped-out portions. In any event, the outer end region of the collar 14 projects beyond this distance for sealing purposes.

In reality, the introduction slope 27 is drawn or curved inward by a multiple of the wall thickness of the collar 14. The drawings illustrate an introduction slope 27 which is formed from a plurality of separate introduction tongues 29. These are projections which are in the shape of mussel shells with an approximately half-round contour. The introduction tongues 29, of which there is a multiplicity and which are distributed at equal intervals, cover the entire circumference of the overall introduction slope. Therefore, the result is a ring of inwardly curved fingers. On account of their externally convex curvature, which is clearly apparent from FIG. 15, there is in practice even a hemisphere-like head of the hollow collar 14. This feels its way into the circular neck opening 11 without problems, even when it is fed in non-linear fashion in the longitudinal center axis x-x. Continuing the knocking-on operation further deflects the, for example, slightly inclined collar 14 or the entire insert part 2 into a coaxially oriented position with respect to the bottle-neck center axis.

The closure cap 1 is childproofed at the insert part 2. For this purpose, the insert part 2, in a region of the connection piece 13 which is close to the cover 8, has a tooth-like latching shaped-out portion 30. This is radially oriented and has its roots both in a pedestal step 31 at that location and in the top side of the cover 8.

The latching shaped-out portion 30 interacts with a mating projection 32 on the closure cap 1. When the closure cap 1 is screwed shut, the two parts 1, 2 are in rotation-blocking engagement. On account of the rotational fixing of the insert part 2 in the neck opening 11, there is also no rotary movement of the closure V with respect to the bottle neck 3.

Figure 8:
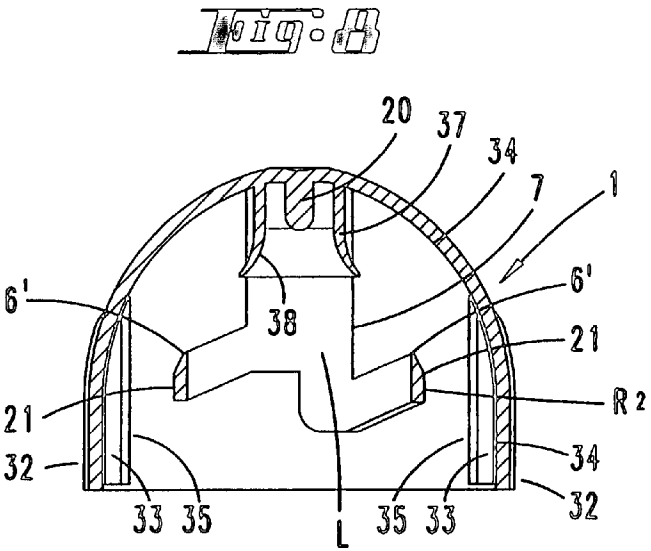
FIG. 8 shows the section on line VIII—VIII in FIG. 6.
Figure 6:
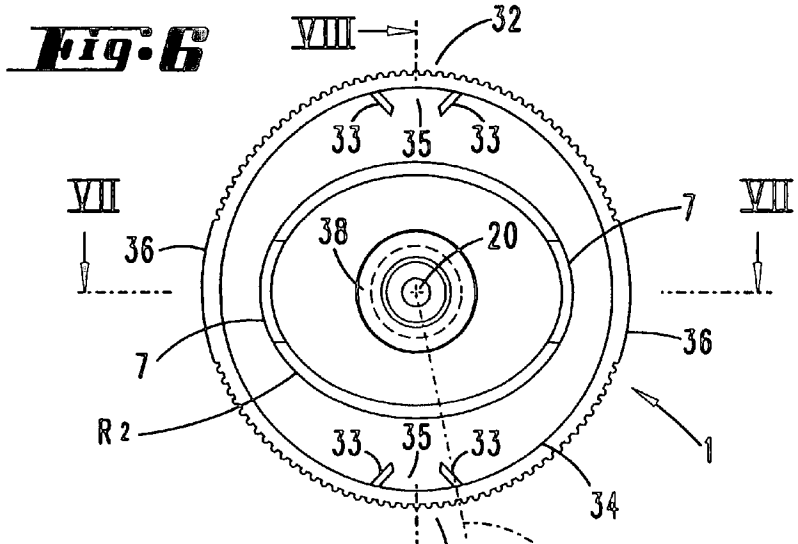
FIG. 6 shows a view of the closure cap from below.
Figure 7:
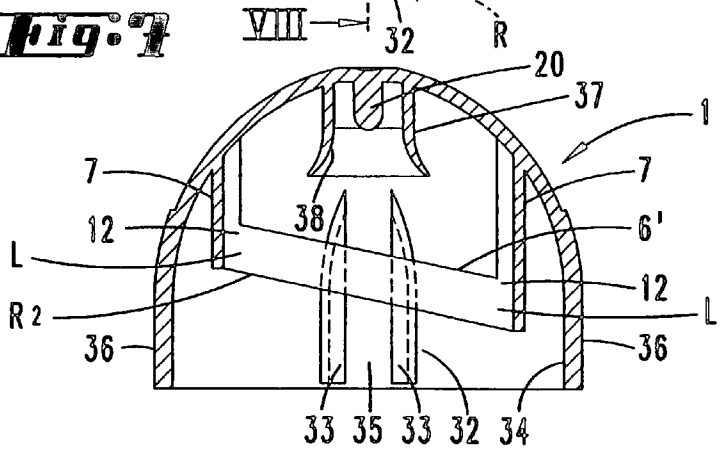
FIG. 7 shows the section on line VII—VII in FIG. 6.

The mating projection 32 can be seen particularly clearly from FIGS. 6 to 8. These are elements which are molded integrally in the interior of the closure cap 1.

Both the latching shaped-out portion 30 and the mating projections 32 are formed in pairs and, in terms of parts, are in each case disposed so as to lie on a common diametral.

The mating projections 32 are formed as strips 33 which are disposed mirror-symmetrically, are directed toward one another in cross section and extend substantially in the radial direction. They have roots in the inner wall 34 of the circular body, which in the upper region is, as it were, of hemispherical shape, of the closure cap 1. The longitudinally oriented strips 33 leave an opening 35 between them at their free ends. This opening 35, which runs in the insertion direction of the closure cap 1, has a clear width between the ends of the strips 33 which corresponds to the width, measured in this direction, of the latching shaped-out portion 30 of the closure cap 1. The strips 33 converge toward the center of the closure cap 1, and specifically at an angle of approx. 45° with respect to a center-oriented line, starting from the root, corresponding to a radial R.

The strips 33, like the closure cap 1 and also the other closure-forming elements, consist of plastic, it being ensured that the material has a sufficient restoring capacity. Therefore, the strips 33 act in the manner of spring tabs. In operation, they are subject to different loads. Depending on the type of screw thread, namely a right-hand or left-hand thread, one or other tab is passed over with respect to the rear side during the final stage of the screwing movement of the closure cap 1. While in this case one strip 33 of the mating projections 32 moves over the latching shaped-out portion 30 and is restored again, the other strip 33 acts as a rotation-blocking stop for the closure cap 1, in which the latching shaped-out portion 30 suppresses further rotation. This occurs at the same time as the time at which the end edge, reaching the end of the screwing movement, comes into contact with the corresponding shoulder, in this case the cover 8, of the bottle vessel 4 or bottle neck 3.

Accordingly, the childproofing means is, at the same time, also responsible for preventing rotation in the reverse direction.

To open the closure V, it is always necessary for a secret release feature to be deliberately exercised. The cup-shaped structure and the flexibility of the closure cap 1, i.e. primarily the cylindrical region of its wall, are utilized for this purpose. This is such that the strips 33 can be lifted away from the latching shaped-out portion 30 as a result of sections 36 of the cap wall of the closure cap 1 being depressed at positions which are offset through 90° with respect to 32. Said sections 36 likewise extend in a common diametral of the closure cap 1. Moreover, they (36) are of thickened-wall configuration, and can also be recognized through the fact that roughening striations, which increase the grip, on the outer wall of the closure cap 1 are minimized. In this way, the closure cap 1 can be unscrewed.

With respect to the ring R2, the same features as those described above with respect to the ring R1 are employed, and the reference numerals, where required in order to gain an understanding, are transferred.

It then remains to point out that the stopper 20, at the zenith of the cover of the closure cap 1, which is in this case of dome-shaped configuration, is also surrounded by a centering funnel 37, which likewise has its roots in the cover. This opens out in the direction of the insert part 2 or bottle neck 3 and thereby reliably encloses the spray nozzle 15, which projects upward in the manner of a chimney, resulting in centering of the stopper 20 with respect to the nozzle opening 19. The annular space between the axially oriented stopper 20 and the foot of the centering funnel 37 is such that the upper, cylindrical end of the spray nozzle 15 is readily accommodated therein.

The inner guide-in slope, which is curved convexly in a rotationally symmetrical manner, bears the reference numeral 38.

By way of example, FIG. 15 also shows a bulge 39, which reduces the standing height of the strap of the ring R1. This has the effect of facilitating latching with respect to the upper flank, which drops obliquely downward, of the corresponding latching projection 5.

Figure 5:
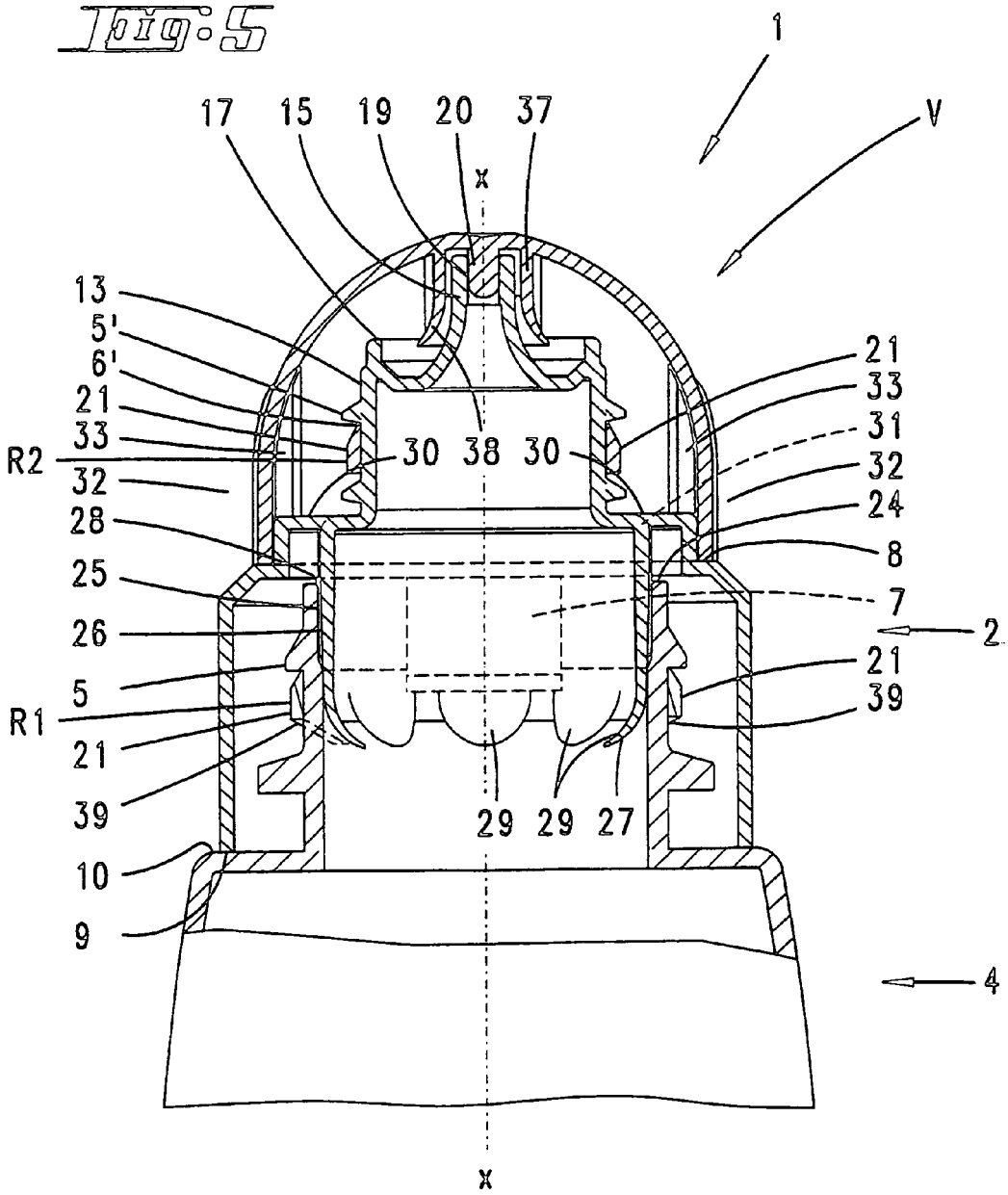
FIG. 5 shows the section on line V—V in FIG. 4.
Figure 16:
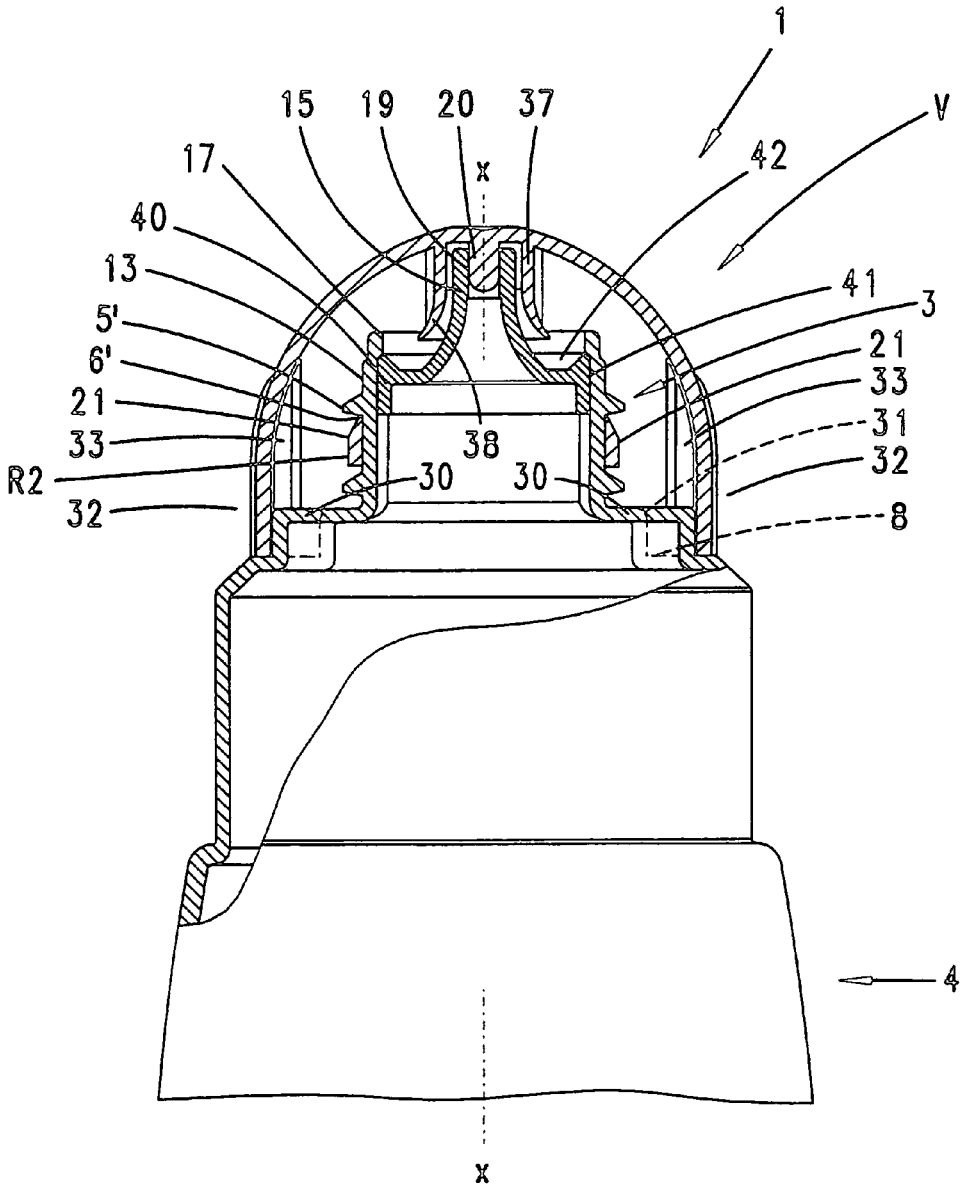
FIG. 16 shows a vertical section through a further developed closure, in which the insert part rests directly on the bottle vessel, i.e. on the bottle neck, or directly forms this component.
Figure 11:
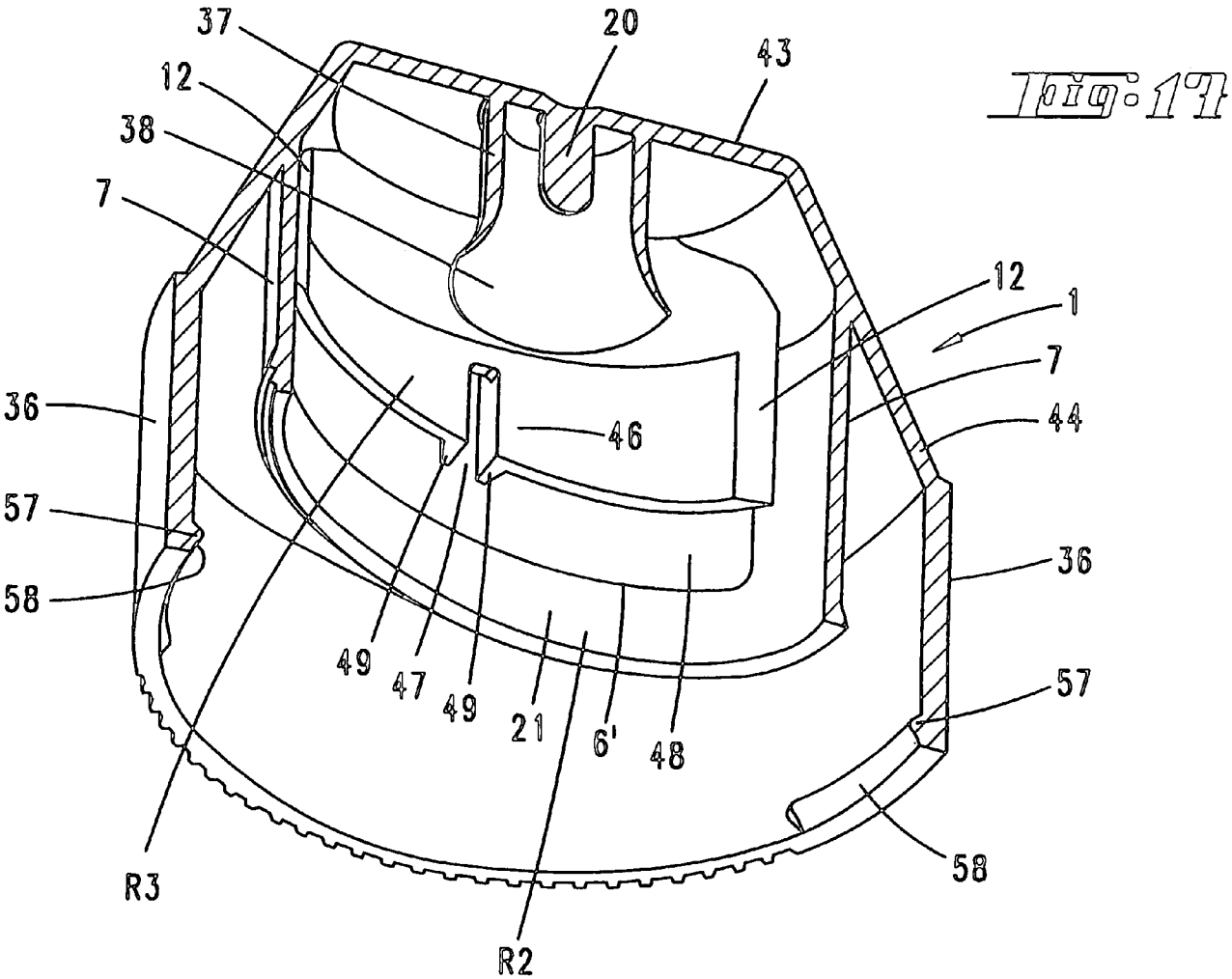

The variant represented in FIG. 16 is comparable to the sectional illustration FIG. 5. The reference symbols are applied accordingly.

In this case, a modification compared to the basic version consists in the fact that the insert part 2 is directly connected to the bottle vessel 4, so that, accordingly, the connection piece 13 in the narrower sense now forms the bottle neck 3 of the bottle vessel 4.

The ring R2 is used to retain the closure cap 1 of the closure V.

The latching shaped-out portions 30 in combination with the mating projections 32 which have been described in detail in this case are responsible both for child-proofing and for the function of the rotation-blocking stop.

A modification with respect to the spray nozzle 15 is embodied by the fact that it can be associated in the manner of a stopper with the neck opening of the connection piece 13 and is not formed integrally therewith. This has the advantage of variability with regard to the diameter of the nozzle opening 19 or the nozzle shape overall. As can be seen from this figure, the base of the spray nozzle 15 merges into a plug-in edge 40. The latter can be snapped into an annular groove 41 of corresponding shape in the neck opening of the connection piece 13. The plug-in edge 40, which is in the form of a section of a sleeve, is axially secured by being engaged over at both ends by flanks of the annular groove 41.

The base of the connection piece 13 forms a channel 42 which is formed circumferentially around the foot of the spray nozzle 15. It is significantly set back with respect to the upwardly projecting connection-piece rim 17 of the connection piece 13.

The developments shown in FIGS. 17 to 20 provide functional separation of the childproofing means from those of the rotation-blocking stop. These means are either realized directly on the bottle neck 3 or are on the insert part 2, which has been extensively described, and the closure cap 1. The reference numerals, where they are required in order to gain an understanding, are applied accordingly, in some cases without corresponding text being repeated.

Starting firstly with the childproofing means: this has now been shifted out of the region of the pedestal step 31 and is accommodated just below the cover 43 of the closure cap 1. The cover 43 appears as a flattened portion and merges, via a frustoconically dropping part, into a cylindrically held end region of the cap wall 44. The sections 36 for actuating the childproofing, i.e. the ovalled-out part of the ring R2, are also located on said cylindrical end region.

On the closure lid side, the latching shaped-out portion 45 in this respect is now positioned above the latching projection 5', this portion 45 interacting with a mating projection 46 either on the insert part 2 or on the bottle neck 3. The latch-forming elements may also be associated with one another in the reverse way.

Figure 18:
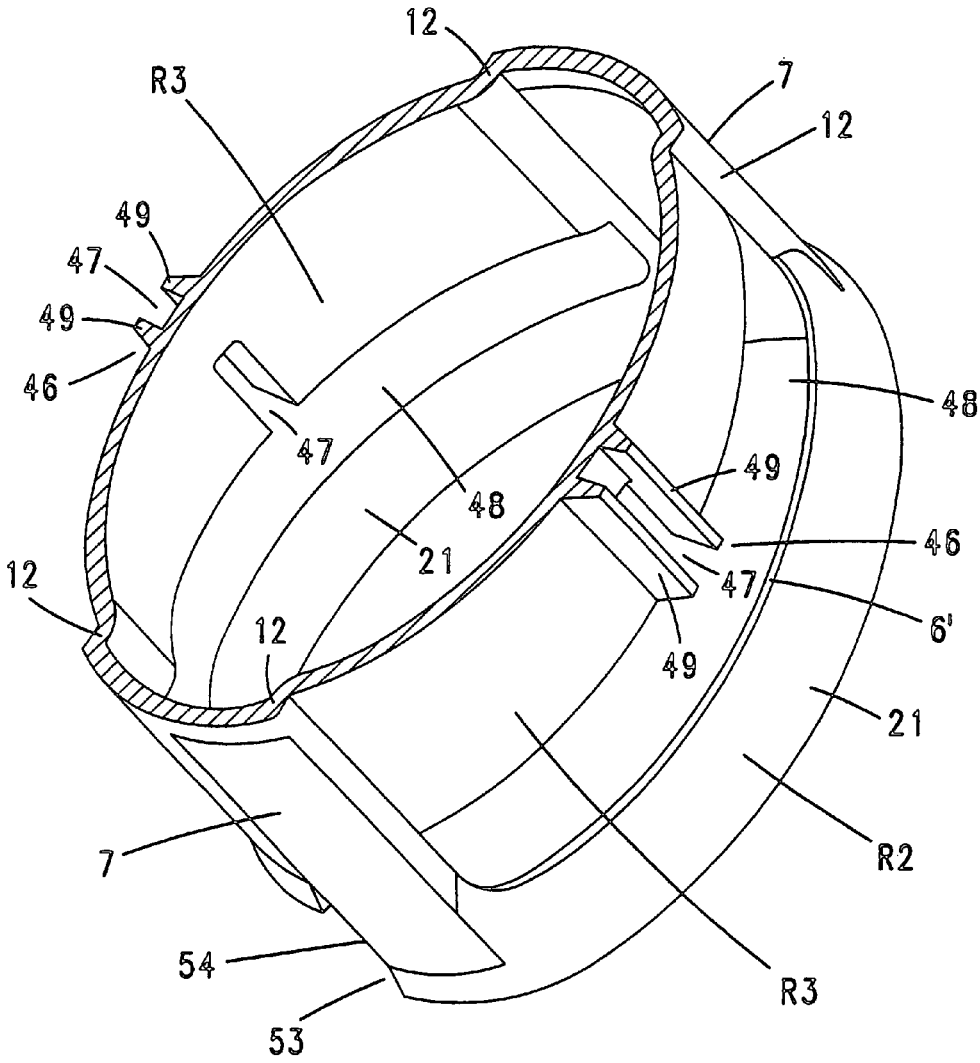
FIG. 18 shows an isolated illustration of the interior of the closure cap, on a further enlarged scale.
Figure 19:
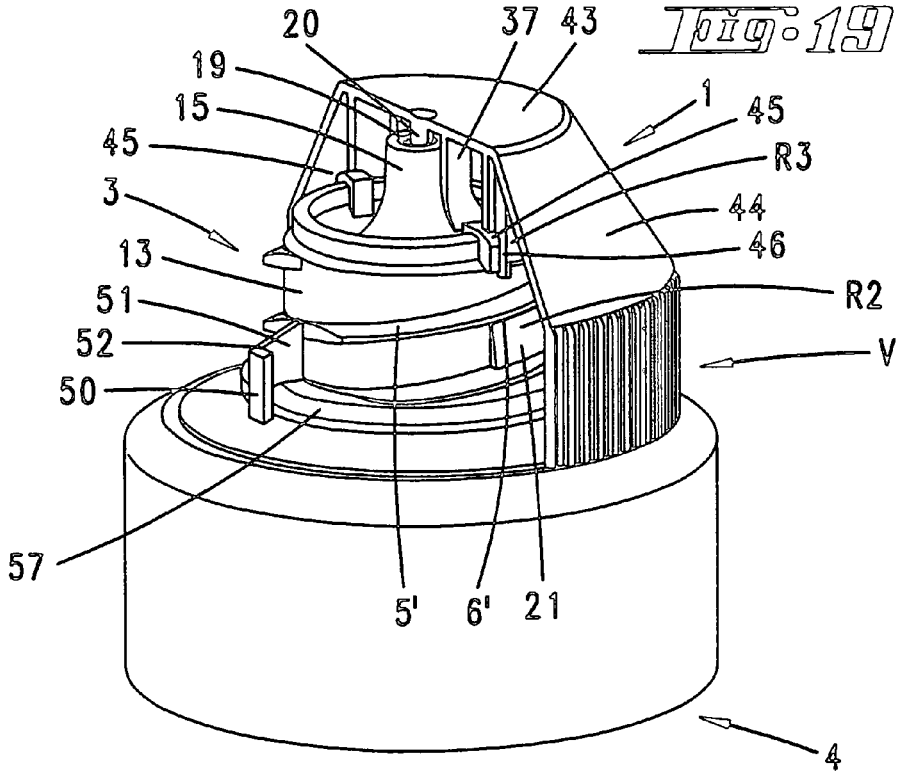
FIG. 19 shows this closure with the closure cap associated, illustrating the function of the childproofing means.

With regard to the mating projection 46, the specific exemplary embodiment provides a recess 47 on the closure cap 1. Reference is made to FIG. 18. In this figure, the recess 47, as can be seen, is implemented and can be recognized as a vertically oriented slot.

The slot is located in a security wall R3 which is separate from the cap wall 44 of the closure cap 1. It has an oval basic contour, i.e. circumferentially substantially follows the corresponding profile of the ring R2, which is located at a further distance from the cover.

The recesses 47 lie on the radially larger arc sections of the security wall R3, and specifically in the center. They are located in diametrically opposite positions with respect to the longitudinal center axis x-x. The slots open out in the direction of the bottle vessel 4.

A window 48 is left on both sides between the strap-like bodies, namely the ring R2 and the annular security wall R3, which are geometrically of basically the same configuration. The vertical height of the window is such that the latching projection 5' of the insert part 2 or of the bottle neck 3 is accommodated therein in a latching-effecting manner, so that the engage-under projection 6' of the closure cap 1 engages beneath the latching projection 5' in the manner outlined above in such a manner as to retain it in place.

The slots which are formed in the security wall R3, which is kept very narrow, so that it has good spring properties, on the outer side of the security wall R3 are reinforced by ribs 49 which are formed integrally on the slot-wall end regions and run at right angles thereto. These ribs extend downward as far as the slot entry and extend in the opposite direction as far as the cover 43, where they have their roots. The slot which defines the recess 47 covers a good two thirds of the height of the security wall R3 in the formation region.

The ring R2, which interacts with the latching projection 5', is attached to the security wall R3. This is effected, in the manner outlined above, by means of the vertically oriented latching arms 7. The latter extend in the region of the tighter turns, i.e. the radially smaller arc sections of the oval parts R2 and R3. They also have the limbs 12 which provide the desired expansion reserve. For corresponding comparison, reference should be made to FIG. 3. The parallel profile of the limbs 12, which imparts a U-shaped cross section of the latching arms 7, is effected on both oval bodies, but may differ in terms of extent. With respect to the security wall R3, the length of the limbs 12 is selected to be such that the security wall R3 is arranged to be offset considerably toward the radially inner side with respect to the attached ring R2. Reference is made to FIG. 18. The offset may amount to a dimension of between one and three wall thicknesses, but an intervening value is preferably employed.

In the tighter turns, the security wall R3 already has its roots in the frustoconical part of the cap wall 44. The strap sections which have a larger-radius arc, i.e. those which bear the recesses 47, by contrast, are located in the planar region of the horizontal cover 43 of the closure cap 1. This results in excellent anchoring in the closure cap 1, which absorbs actuating forces. The upper, root-forming end edge of the security wall R3 therefore runs in at changing levels in terms of height. In this way, the security wall R3 is connected to the cap wall 44, which is moved by the release pressure, so that the movement is guided optimally. The release pressure is effected via the sections 36 which are provided in this case too.

The ovalled-out portion of the closure cap 1 is transferred in different ways to the oval inner and outer straps. The transmission of deformation work to the ring R2 is relatively small, and leaves its engage-under projection securely beneath the thread flank of the insert part 2 or bottle neck 3.

On account of the proximity to the cover of the security wall R3, this wall is the recipient of a greater transmission of deformation work, i.e. it likewise becomes oval in such a manner that the horizontal surface-engagement zones of the windows 48 of the security wall R3 with respect to the insert-part ribs are reduced.

With regard to the latching shaped-out portion 45, the latter is located on the connection piece 13, more specifically on the upper-side connection-piece rim 17. It is realized as a transverse rib, specifically in diametrically opposite positions with respect to the longitudinal center axis x-x.

The latching shaped-out portion 45, which is in the form of a transverse rib, projects significantly, in cantilevered fashion, beyond the crest of the planar connection-piece rim 17. The latching shaped-out portions 45, which are provided in pairs, in the closed position of the closure V are located crosswise with respect to the release-pressure direction of the closure.

The transverse ribs, which are configured in the manner of slides and, like the above latching shaped-out portions 30 are of tooth-like configuration, have an active latching action. Release is effected by the actuating force or movement introduced via the zones of the latching arms 7. The arc profile of the parts of the security wall R3 which have the recesses 47 lift off the active latching zones of the latching shaped-out portion 45.

Since in this case too the closure cap 1 is configured as a screw cap, the windows 48 rotate freely out of the retaining region of the latching projections 5', which are realized as screw threads. This takes place in the manner illustrated in detail above.

Figure 20:
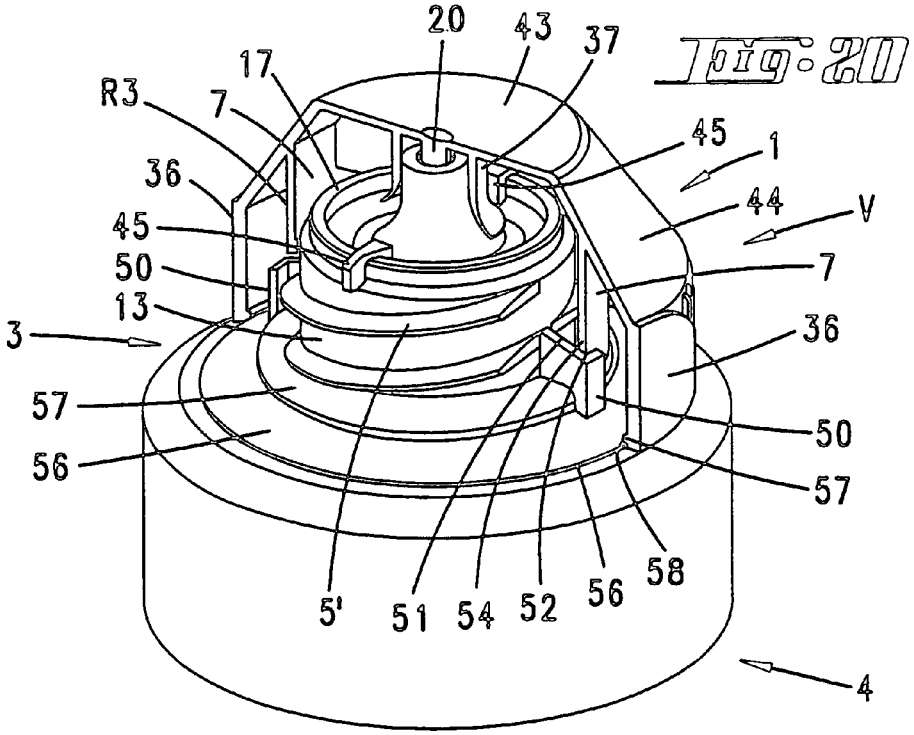
FIG. 20 shows the same form of illustration, emphasizing the function of the rotation-blocking stop.

Now to the rotation-stop blocking means: the rotation-stop blocking, which is in this case separate from the childproofing, can be seen particularly clearly from FIG. 20 with respect to the neck-side means. In this case, a rotation-latching shaped-out portion 50 is located on the outside at the foot of the connection piece 13. This portion is hook-shaped in terms of its basic contour. Its radial hook limb forms a stationary stop edge 51. The hook shape results in a trapping corner 52 for the closure-cap-side mating latching means. This is a mating projection 53 formed integrally on the closure cap 1. It runs rotationally symmetrically in the path or on the route of the stop edges 51, which are formed to lie diametrically opposite one another. The trapping corner 52 is open in the feed direction of the mating projection. This means the screwing-on direction of the closure cap 1.

That limb of the hook-shaped rotation-latching shaped-out portion 50 which faces the circumferential direction acts so as to wrap around the ring R2.

The mating projection 53 is formed by a step edge 54 of the strap-like ring R2. The step results from the rising profiles of the sections 21 of the ring R2 in the region of the respective lower, saw tooth-like new stop. Reference is made to FIG. 18, which shows the step edge 54 as a narrow edge which is oriented spatially parallel to the longitudinal center axis x-x and ultimately comes flush into contact with the stationary stop edge 51. It is a particularly stable rotation-blocking stop, reinforced further by the paired configuration.

At the foot side, the connection piece 13 merges in step form, via a noticeable annular bead 55, into a rotationally symmetrical slope 55 which drops outward. It ends in a vertical annular step 56 of short height. The latter is adjoined by a rim zone, which likewise drops obliquely, of the pedestal step 31.

The closure cap 1, which is of cup-like configuration, is supported on the annular step 56 by means of its inner lower rim. This counteracts the undesired locating of the release section 36.

Conversely, it requires these section 36 to be deliberately pressed inward, which entails overcoming the annular step 56. One can speak in this context of a response threshold.

In the region of the sections 36, the closure-cap rim has a bead 57. This projects inward and, by means of its lower edge, forms a short run-up slope 58. Taking the corresponding obstacle of the annular step 56, this already results in a component in the vertical lifting direction on the closure cap 1. In this way, unscrewing of the cap is promoted.

In this version too, the closure cap 1 can be knocked on, with the ring R2 being widened in the circumferential direction, overcoming the latching projections 5' of the threaded sections, which are in the way. Emergence from the threaded section takes place via the thread-free regions, which can be seen from the drawing illustrations.

I claim:

1. A closure for a bottle vessel having a neck, the closure comprising a closure cap (1) and an insert part (2) that receives the closure cap and is mountable on the neck, wherein the insert part (2) has means for holding on the bottle neck (3) in a manner secured against rotation, and the closure cap (1), which is knockable onto the insert part (2), is unscrewable from the insert part (2); and wherein the closure further comprises, for childproof holding of the closure cap to one of the insert part or the neck, a latching shaped-out portion (30) that interacts with a mating projection or recess on the closure cap, wherein the insert part (2) includes a connection piece (13), and a cover (8) on the insert part (2), said connection piece includes a spray nozzle (15) and an inner cover (16) located between the spray nozzle and the cover (8), the spray nozzle being centrally located; the insert part (2) has a cup shape and continues into the connection piece (13) which extends in a direction away from the interior of the cup shaped insert part, starting from the cover (8), the spray nozzle (15) rises from the base of the inner cover (16) of the connection piece (13), and the inner cover (16) runs parallel to the cover (8).

2. The closure according to claim 1, wherein a latching projection (5) is formed on the neck, and wherein an engage-under projection (6) is formed on the insert part (2) so as to interact with the latching projection (5) on the neck of the bottle vessel (4).

3. The closure according to claim 2, wherein the engage-under projection (6) of the insert part (2) is formed on a circumferentially encircling ring (R1) which, in circumferential direction, has a length reserve (L) which is sufficient to move over the latching projection (5) and is utilizable with elastic restoring.

4. The closure according to claim 3, wherein the length reserve (L) is formed on account of an undulating construction of the ring (R).

5. The closure according to claim 3, wherein the length reserve (L) is formed by an ability to yield in a region of attachment to the latching arm (7) of the ring (R1).

6. The closure according to claim 3, wherein the ring (R1) runs substantially perpendicularly to latching arms (7).

7. The closure according to claim 2, wherein the engage-under projection (6) is configured for mating with a corresponding configuration of the latching projection (5), in that the latching projection (5) is formed on the bottle neck (3) in a plane which runs perpendicular to center axis (x-x) of a bottle opening (11) of the bottle neck (3).

8. The closure according to claim 2, wherein the latching projection (5) extends radially outward from the bottle neck (3), and the insert part (2) has an inwardly extending projection to engage with the latching projection.

9. The closure according to claim 8, wherein a mating projection (32) is formed on the closure cap as strips (33) which are configured mirror-symmetrically, are directed toward one another in cross section and extend in radial direction, and which, at their free ends, between them leave an opening (35) which corresponds to the latching shaped-out portion (30).

10. The closure according to claim 9, wherein there are two mating projections (32) which lie on a diametral.

11. The closure according to claim 9, wherein the stripe (33) are liftable away from the latching shaped-out portion (30) by depressing sections (36) of a peripheral wall of the closure cap (1) in positions which are offset at 90° with respect thereto.

12. The closure according to claim 1, wherein a latching projection (5) is formed on the neck, and wherein the latching projection (5) is formed on the bottle neck (3) which has a neck opening (11), and a latching arm (7) runs substantially parallel to a longitudinal center axis (x-x) of the neck opening (11).

13. The closure according to claim 12, wherein there are formed two said latching arms (7) which lie substantially opposite one another.

14. The closure according to claim 1, wherein the insert part (2) has a central collar (14) for engaging in a neck opening (11) of the bottle vessel (4), the collar (14) having an introduction slope (27) for interacting with an inner-rim edge (28) of the neck opening (11).

15. The closure according to claim 14, wherein the introduction slope (27) extends inward at least by an amount of one wall thickness of the collar (14).

16. The closure according to claim 14, wherein the introduction slope (27) has a dimension which is a multiple of wall thickness of the collar (14).

17. The closure according to claim 14, wherein the introduction slope (27) is formed from a plurality of separate introduction tongues (29).

18. The closure according to claim 17, wherein the introduction tongues (29) are distributed at equal angles.

19. The closure according to claim 1, wherein the means for holding the insert part (2) in a manner which is secured against rotation is formed on a bottle neck side in a form of shaped-out portions.

20. The closure according to claim 19, wherein the shaped-out portions comprise vertically oriented ribs (22).

21. The closure according to claim 20, wherein the ribs (22) are of tongue-like form, with a tongue tip (23) associated with a neck opening (11).

22. The closure according to claim 20, wherein the ribs (22) are formed by recesses (25) in inner wall of the bottle vessel (4).

23. The closure according to claim 1, wherein the means for holding the insert part (2) in a manner which is secured against rotation are formed by blocking strips (26), which pass into recesses (25) between ribs (22), of the insert part (2).

24. The closure according to claim 1, wherein the closure cap (1) has an engage-under projection, and the insert part (2), coordinated to the engage-under projection of the closure cap (1), forms a latching projection (5').

25. The closure according to claim 24, wherein the latching projection (5') of the insert part (2) and the engage-under projection (6') of the closure cap (1), in a lateral projection, include an acute angle (alpha) with a horizontal.

26. The closure according to claim 24, wherein the latching projection (5') is formed as a screw thread on the insert part (2).

27. The closure according to claim 1, wherein a ring (R2) which runs at an acute angle (alpha) comprises two sections (21) which lie substantially opposite one another and cover a same height region.

28. A childproof closure cap (1) for a bottle vessel (4) or for an insert part (2) of a bottle vessel, the closure cap having mating projections (32) formed by strips (33) which are aligned mirror-symmetrically and, in cross section, are directed toward one another such that their free ends, between them, leave an opening (35) for accommodating the latching shaped-out portion (30) of the bottle vessel (4) or of the insert part (2), whereby the strips (33) converse toward a center of the closure cap (1), at an angle of approx. 45° with respect to a center-oriented line such, that in a final stage of the screwing movement of the closure cap (1), one strip (33) of the mating projections (32) moves over the latching shaped-out portion (30) and is restored again, the other strip (33) act as rotation blocking stop for the closure cap (1), in which the latching shaped-out portion (30) suppresses further rotation; wherein the insert part (2) or a bottle neck (3), in a region above a latching projection (5'), has a latching shaped-out portion (45), and wherein the closure cap further comprises a mating projection (46) in a form of a recess (47) for interacting with the latching shaped-out portion (45); and wherein the recess (47) is formed in a security wall (R3) which is separate from a cap wall (44) of the closure cap (1) and is disposed radially inwardly with respect thereto.

29. The childproof closure cap for a bottle vessel according to claim 28, wherein the security wall (R3) has an oval basic contour.

30. The childproof closure cap for a bottle vessel according to claim 28, wherein a ring (R2) which interacts with the latching projection (5') is attached to the security wall (R3).

31. The childproof closure cap for a bottle vessel according to claim 30, wherein the attached ring (R2) is configured as a strap, with an oval basic contour which is matched to the security wall (R3).

32. The childproof closure cap for a bottle vessel according to claim 30, wherein the security wall (R3) is disposed so as to be radially inwardly offset with respect to the attached ring (R2).

33. The childproof closure cap for a bottle vessel according to claim 28, wherein the security wall (R3) is connected to the cap wall (44) which is moved by release pressure.

34. An assembly of a bottle vessel with a closure cap (1) secureable to a neck of the bottle vessel (4), the assembly including a latching projection (5) formed on the bottle neck (3), the assembly further comprising an insert part (2) for connecting the closure cap to the neck, and an engage-under projection being formed on the closure cap (1), said insert part (2) being fastenable to the bottle neck (3), and wherein the closure cap (1), which is knockable onto the insert part (2), is unscrewable from the insert part (2), wherein the insert part (2) has means for holding on the bottle neck (3) in a manner secured against rotation, wherein a latching projection (5) is formed as a screw thread on the insert part (2), and for a childproof holding of the closure (1) on the insert part (2), the insert part (2) or the bottle neck (3), in a region of a pedestal step (31), has a latching shaped-out portion (30) which interacts with a mating projection or a recess on the closure cap (1); wherein the closure insert part (2) includes a connection piece (13), and a cover (8) on the insert part (2), said connection piece includes a spray nozzle (15) and an inner cover (16) located between the spray nozzle and the cover (8), the spray nozzle being centrally located; the insert part (2) has a cup shape and continues into the connection piece (13) which extends in a direction away from the interior of the cup shaped insert part, starting from the cover (8), the spray nozzle (15) rises from the base of the inner corer (16) of the connection piece (13), and the inner cover (16) runs parallel to the cover (8).

* * * * *